United States Patent [19]

Beneziat et al.

[11] 4,410,085

[45] Oct. 18, 1983

[54] DRINKING GOBLET ENABLING TWO DOSES OF CONSTITUENTS TO BE MIXED JUST BEFORE CONSUMPTION

[75] Inventors: Alain Beneziat, Thil; André Silaire, Gif sur Yvette, both of France

[73] Assignee: Manufacture Lyonnaise de Bouchage, Lyons, France

[21] Appl. No.: 374,546

[22] Filed: May 3, 1982

[51] Int. Cl.[3] ..... B65D 81/32; B65D 85/72; B65D 51/28

[52] U.S. Cl. ..... 206/217; 206/221; 206/219; 220/23; 215/6; 222/142.5

[58] Field of Search ..... 206/217, 221, 219, 459, 206/306; 220/23; 215/6; 222/142.5

[56] References Cited

U.S. PATENT DOCUMENTS

| | | | |
|---|---|---|---|
| 937,049 | 10/1909 | Callahan | 222/142.5 |
| 2,545,302 | 3/1951 | Perezlias | 206/221 |
| 2,981,435 | 4/1961 | McCarthy | 220/23 |
| 3,275,180 | 9/1966 | Optner et al. | 206/459 |
| 3,407,922 | 10/1968 | Palmer | 206/219 |
| 3,696,919 | 10/1972 | Miles | 215/6 |
| 3,741,383 | 6/1973 | Wittwer | 215/6 |
| 3,856,138 | 12/1974 | Maekawa et al. | 206/221 |
| 3,918,920 | 11/1975 | Barber | 206/306 |

*Primary Examiner*—William T. Dixson, Jr.
*Attorney, Agent, or Firm*—Dowell & Dowell

[57] ABSTRACT

The tumbler according to the invention comprises a recipient in the form of a glass whose bottom is provided with an axial tube in which is screwed the open base of a sleeve containing a flask, the opening of the latter being hermetically applied against a seal. When this sleeve is unscrewed, the contents of the flask mix with those of the glass. Other variants are possible according to the invention.

7 Claims, 7 Drawing Figures

DRINKING GOBLET ENABLING TWO DOSES OF CONSTITUENTS TO BE MIXED JUST BEFORE CONSUMPTION

The present invention relates to a drinking tumbler enabling two doses of constituents to be mixed at the moment of consumption.

A certain number of drinks are known to be constituted by mixing well defined quantities of two constituents of the drink which may be composed either of liquids or of a liquid and a powdered product, it being observed that, for reasons of preservation or freshness of taste, it is necessary or merely advantageous if this mix is effected immediately before consumption. By way of non-limiting example, mention may be made of drinks flavoured with aniseed (such as in particular aniseed aperitifs called "pastis" or "anisette"), comprising in principle five volumes of water for one volume of liqueur.

It is an object of the present invention to provide, as new industrial product, a drinking tumbler specially arranged to allow the preparation, preservation, transport and dispensing of drinks of the above-mentioned type, of which the two constituents are mixed just before consumption, under the best conditions desirable.

The tumbler according to the invention is essentially noteworthy in that it comprises a recipient in the form of a glass inside which a hermetically closed flask containing one of the two constituents is held fast, the opening of the recipient or glass being closed by a heat-welded lid so as to contain the second constituent of the drink around the said flask.

The invention will be more readily understood on reading the following description with reference to the accompanying drawings, in which.

Figure 1:
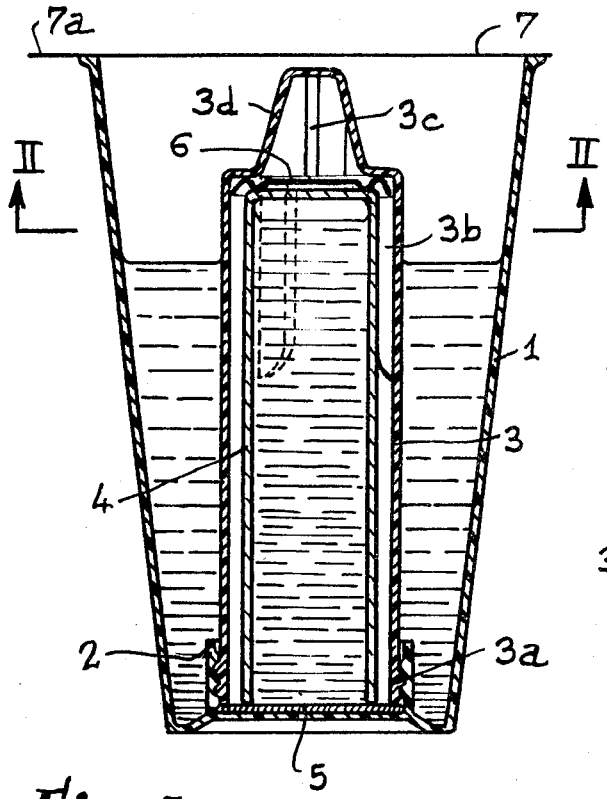
FIG. 1 is a schematic axial section of a drinking tumbler according to the invention.
Figure 3:
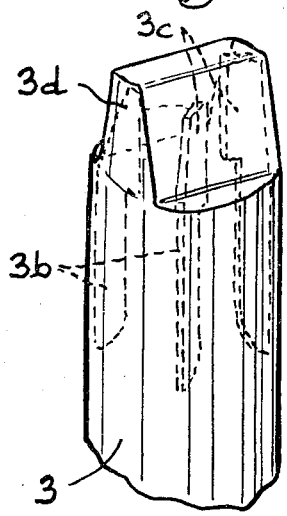
FIG. 3 shows the top part of the sleeve containing the flask of the tumbler of FIGS. 1 and 2.
Figure 2:
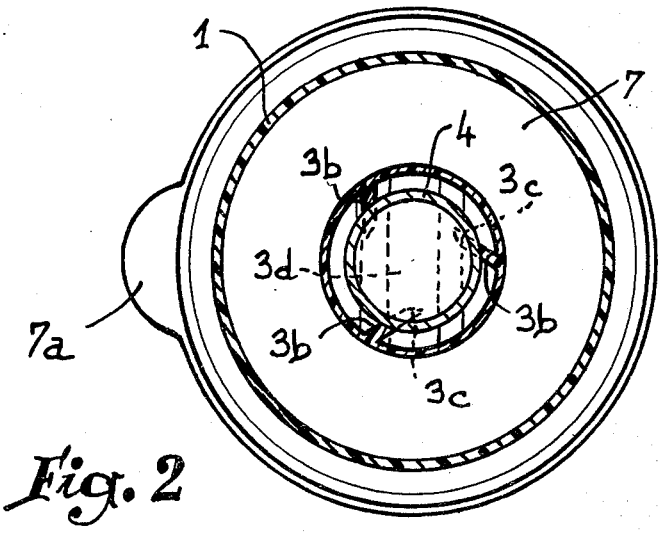
FIG. 2 is a transverse section thereof along the plane indicated at II—II in FIG. 1.

Referring now to the drawings, in the embodiment shown in FIGS. 1 to 3, the tumbler according to the invention comprises a recipient 1 in the form of a glass, which is assumed to be made of transparent synthetic material. The bottom of this glass 1, which is provided to be slightly raised, is fast with a short axial tube 2 whose inner wall is provided with a helical thread; in this tube 2 is screwed the open base 3*a* of a cylindrical sleeve 3 made of plastics, preferably transparent material. The inner wall of this sleeve 3 comprising wedging fins 3*b*, three in number in the example envisaged, and oriented obliquely towards the inside; the top of these fins 3*b* is connected to stops or edges 3*c* which extend in the upper part 3*d* of the sleeve 3, which upper part 3*d* has the tapering profile shown in FIG. 3 to facilitate grip, as will be more readily understood hereinafter.

In the sleeve thus constituted is engaged a glass flask 4 whose opening is turned downwards, abutting against a seal 5 housed in the tube 2. The diameter of this flask 4 is such that its cylindrical side wall is centred and wedged between the deformable fins 3*b*, whilst its upwardly turned bottom is maintained by the upper stops 3*c*, with the interposition of a wedging disc such as 6. Finally, it will be noted that the opening of the glass 1 is closed by a heat-welded lid 7 provided on the side with a gripping tab 7*a*.

The flask 4 may be automatically filled whilst it is engaged in the sleeve 3, the end 3*d* thereof then being turned downwards. The recipient or glass 1 being downwardly open, the sleeve 3 is screwed by its base 3*a* in the tapped tube 2; the seal 5 ensures tightness of the closure of the flask 4, whilst the disc 6 compensates the slight differences in height which may affect the flasks. The glass 1 is then upturned and filled, and the lid 7 is finally positioned.

It will be noted that the two liquid constituents which fill the flask 4 and the glass 1 respectively are maintained separate, without any risk of mixing. The annular space made by the fins 3*b* forms insulation and avoids any excess cooling or heating of the liquid contained in the flask 4.

When the consumer wishes to drink, he tears off and discards the lid 7. It then suffices to grip the top part 3*d* of the sleeve 3 and turn it in an unscrewing motion; the contents of the flask 4 will then mix with the contents of the glass 1, at the bottom of the glass. The assembly formed by the sleeve 3 and the flask 4, rendered fast with each other by the fins 3*b*, may be withdrawn from the glass 1 which may then be used to consume the drink obtained by mixing the two doses of constituents.

Figure 4:
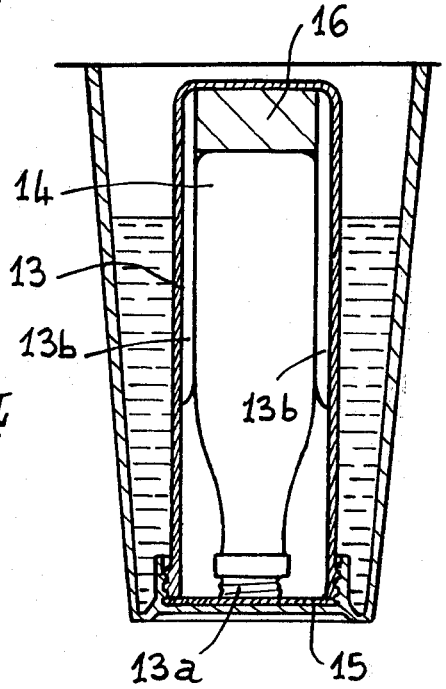
FIG. 4 shows a variant of the tumbler of FIG. 1.

FIG. 4 illustrates a variant in which the flask mounted inside the sleeve 13 is constituted by a small bottle 14 of type known per se in the alcohol market, the opening of the neck 14*a* being closed by bearing against the seal 15. The fins 13*b* ensure centering of this bottle 14 and connection thereof with the sleeve 13, axial wedging being ensured by an elastically compressible upper buffer 16.

This tumbler is of course used in the same manner as set forth hereinabove with reference to FIGS. 1 to 3.

Figure 5:
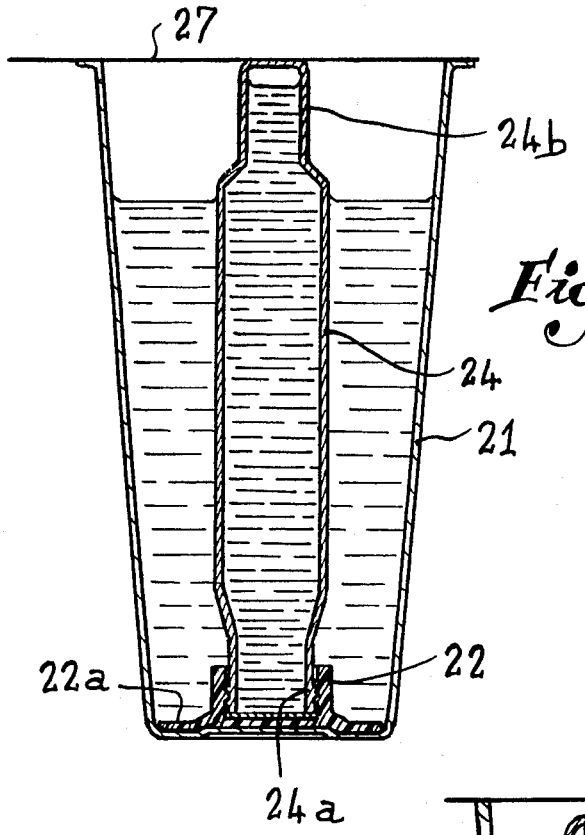
FIG. 5 is an axial section illustrating another embodiment of the invention.

FIG. 5 illustrates another embodiment of the tumbler according to the invention. This is a recipient or glass 21 whose bottom is provided with a tapped tube 22, but it is the open base or neck 24*a* of the flask 24 which is hermetically screwed in said tube. The sleeve 3 and 13 of the preceding embodiments is thus dispensed with, it being observed that the lid 27 fixed on the open edge of the recipient 1 may advantageously be fixed against the upwardly turned bottom of the flask 24 which is thus held axially in said recipient; this bottom is advantageously provided to have a tapering profile, as shown at 24*b*, so as to facilitate unscrewing of the flask 24 before consumption.

It will be noted that the tube 22 may then be independent, by providing it with an annular base 22*a* adapted to give it better stability; the flasks 24 may thus be filled in advance and stored full, being stoppered by the tube 22-22*a*, their fixing in the glasses 1 being effected at the last moment, i.e. when the latter are filled and closed by the lid 27.

Figure 7:
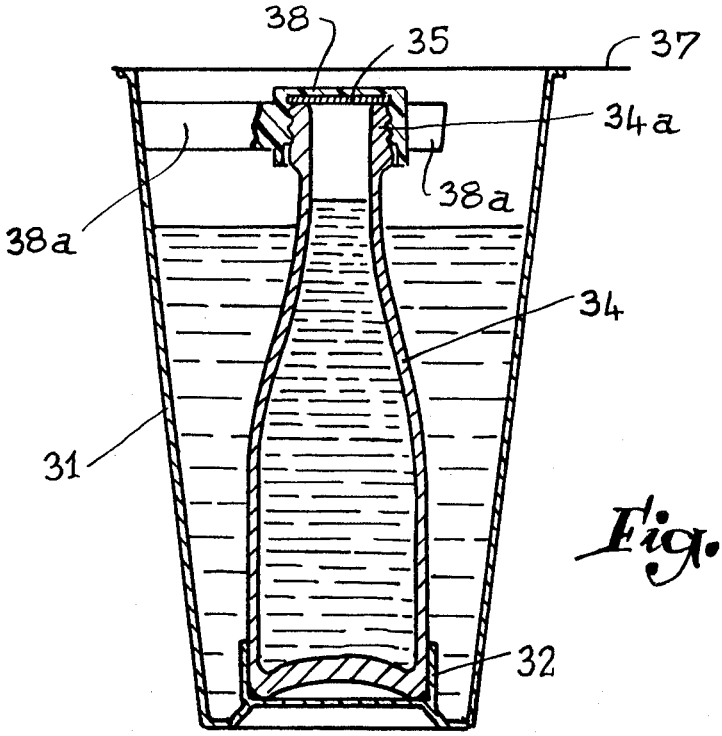
FIGS. 6 and 7 show, in plan view and in axial section, a tumbler according to a fourth variant embodiment.
Figure 6:
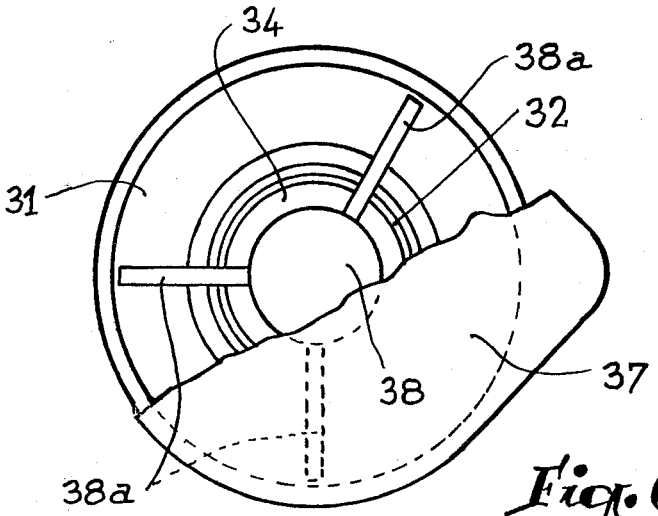

FIGS. 6 and 7 illustrate yet another embodiment, in which the tumbler comprises a glass flask 34 whose base is centred inside an axial tube 32 fast with the bottom of the glass 31. This flask 34 is closed by a stopper 38 screwed on the neck 34*d* with the interposition of a sealing disc 35. This stopper 38, disposed immediately below the lid 37, is fast with radial arms 38*a* which ensure wedging of the flask 34 inside the glass 31, by bearing against the inner wall of said glass.

It must be understood that the preceding description has been given only by way of non-limiting example and that the replacement of the details of execution described by any other equivalents would not depart from the scope of the invention. In particular, the recipient and the bottle may have any profile and any mode of stoppering.

What is claimed is:

1. Drinking tumbler allowing two doses of constituents to be mixed just before consumption, wherein it comprises a recipient in the form of a glass, inside which is maintained a hermetically closed flask containing one of the two constituents, the opening of said recipient or glass being closed by a heat-welded lid so as to contain the second constituent around the said flask.

2. The tumbler of claim 1, wherein the opening of the flask is turned downwardly and is closed by application against the bottom of the recipient or glass.

3. The tumbler of claim 2, wherein the bottom of the recipient or glass is provided with a short axial tube whose inner wall is threaded, the space defined by this tube being provided with a seal.

4. The tumbler of claims 2 and 3 in combination, wherein the tube receives, by screwing, the threaded base of a sleeve whose inner wall is provided with fins and stops which ensure centering of the flask and connection thereof with said sleeve.

5. The tumbler of claim 4, wherein the top of the sleeve has a profile adapted to facilitate rotation thereof.

6. The tumbler of claims 2 and 3 in combination, wherein the neck constituting the opening of the flask is provided with a thread adapted to be screwed in the tube.

7. The tumbler of claim 1, wherein the opening of the flask is turned upwardly and closed by a stopper provided with radial wedging arms applied against the inner wall of the recipient or glass whilst the base of said flask is centred in an axial tube fast with the bottom of said recipient.

* * * * *

UNITED STATES PATENT OFFICE

CERTIFICATE OF CORRECTION

PATENT NO. : 4,410,085

DATED : October 18, 1983

INVENTOR(S) : Alain Bereziat, Andre Silaire

It is certified that error appears in the above-identified patent and that said Letters Patent are hereby corrected as shown below: On the title page

Item No. 75: should read: Alain Bereziat, Thil; Andre Silaire, Gif sur Yvette, both of France Item No. 73: should read: Manufacture Lyonnaise de Bouchage, Lyon, France, and Societe Ricard, Marseille, France.

Signed and Sealed this

*Eighth* Day of *May 1984*

[SEAL]

*Attest:*

GERALD J. MOSSINGHOFF

*Attesting Officer*

*Commissioner of Patents and Trademarks*